US005490337A

United States Patent [19]

Zerbinati

[11] Patent Number: 5,490,337

[45] Date of Patent: Feb. 13, 1996

[54] ARTICLE OF SPORT FOOTWEAR, IN PARTICULAR A SKI BOOT

[75] Inventor: Gianfranco Zerbinati, Montebelluna, Italy

[73] Assignee: Dolomite S.p.A., Montebelluna, Italy

[21] Appl. No.: 368,257

[22] Filed: Jan. 3, 1995

Related U.S. Application Data

[63] Continuation of Ser. No. 131,905, Oct. 5, 1993, abandoned.

[30] Foreign Application Priority Data

May 7, 1993 [IT] Italy ..... PD93A0107

[51] Int. Cl.[6] ..... A43B 5/04

[52] U.S. Cl. ..... 36/119; 36/132; 36/54; 36/71

[58] Field of Search ..... 36/117, 89, 96, 36/132, 136, 54, 119, 114, 120, 121, 50.1, 50.5, 71

[56] References Cited

U.S. PATENT DOCUMENTS

| | | | |
|---|---|---|---|
| 2,789,374 | 4/1957 | Planert | 36/89 X |
| 3,738,025 | 6/1973 | Hanson et al. | 36/117 |
| 4,372,061 | 2/1983 | Pozzobon | 36/117 |
| 4,959,912 | 10/1990 | Kaufman et al. | 36/117 |
| 5,054,215 | 10/1991 | Tonel et al. | 36/117 X |
| 5,174,050 | 12/1992 | Gabrielli | 36/117 |
| 5,265,353 | 11/1993 | Marega et al. | 36/117 |

FOREIGN PATENT DOCUMENTS

| | | | |
|---|---|---|---|
| 0134034 | 3/1985 | European Pat. Off. | 36/117 |
| 0317764 | 5/1989 | European Pat. Off. | 36/117 |
| 2649594 | 1/1991 | France . | |
| 3741601 | 6/1988 | Germany . | |

*Primary Examiner*—Steven N. Meyers
*Assistant Examiner*—Ted Kavanaugh
*Attorney, Agent, or Firm*—Edward D. Manzo; Ted K. Ringsred

[57] ABSTRACT

An article of sport footwear in particular a ski boot, with a boot shell in which a boot entrance is defined for receiving the skier's leg, and with a plate-like lug associated with the shell at the location of the entrance to provide predetermined conditions of support for the skier's leg, wherein the lug is pivotable relative to the shell into at least two working positions where it presents different portions to the entrance, thereby varying the support conditions provided for the skier's leg accordingly.

14 Claims, 5 Drawing Sheets

ARTICLE OF SPORT FOOTWEAR, IN PARTICULAR A SKI BOOT

This is a continuation of application Ser. No. 08/131,905 filed on Oct. 5, 1993 now abandoned.

DESCRIPTION

This invention relates to an article of sport footwear, in particular a ski boot, skating boot, or the like, having a boot shell which incorporates a bootleg portion encircling a boot entrance adapted to receive the skier's leg therethrough.

It is known to form ski boots with a shell of a plastics material having a bootleg portion which carries, in its rearward area, opposite from the shell toe end, a lug commonly called "spoiler" adapted to provide support for the calf region of the skier's leg. The spoiler permits to adopt a proper skiing position.

In order to change the supported condition of the leg to suit a skier's individual morphology, as well as to meet the skier's own requirements, it is known to provide spoilers which are adjustable in height. An example of such technical solutions is described, for instance, in U.S. Pat. No. 5,046,268 by this Applicant.

An adjustable spoiler of that kind does fill even the most exacting of requirements for adjustability, but still has a drawback in that its construction is complicated and only justified for high performance boots. Also, it can only be fitted to the boot in the rearward area thereof.

The underlying technical problem of this invention is to provide an article of sport footwear, such as a ski boot, which is conceived both construction- and function-wise to obviate the drawbacks with which the aforementioned prior art is beset.

This problem is solved, according to the invention, by an article of sport footwear of the kind outlined in the preamble and characterized in that it comprises a plate-like lug associated with the shell at the location of the entrance thereof and effective to provide predetermined support conditions for the skier's leg, said lug being pivotable relative to the shell into at least two working positions where it presents different portions to said entrance such that the support conditions afforded for the skier's leg can be changed accordingly.

The invention will now be described with reference to six preferred applications thereof shown, by way of example and not of limitation, in the accompanying drawings, in which.

Figure 3:
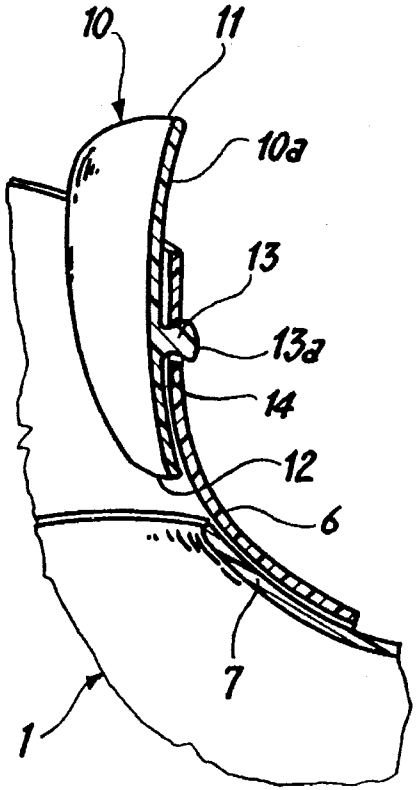
FIG. 3 is a longitudinal section view of a detail of the ski boot in the preceding Figures.
Figure 2:
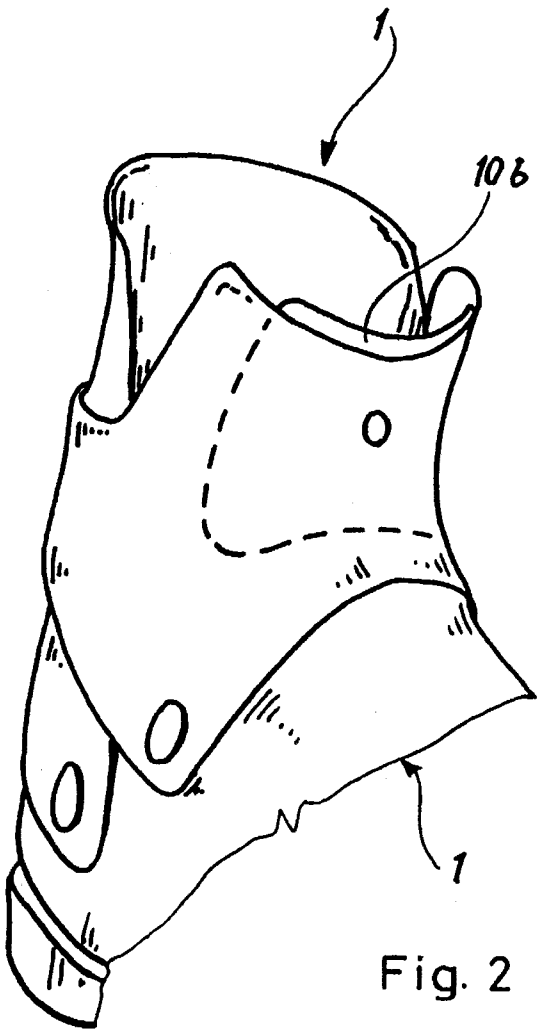
FIGS. 1 and 2 are fragmentary perspective views showing schematically a ski boot according to a first embodiment of the invention.
Figure 1:
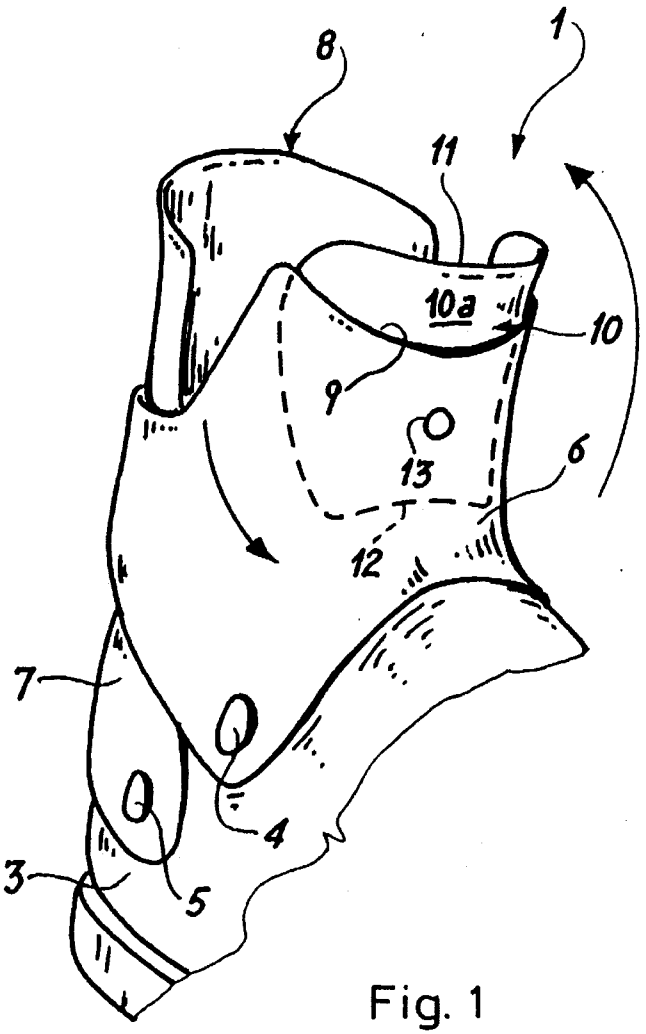

Generally shown at 1 in FIGS. 1 to 3 is a shell of a ski boot constituting a first embodiment of the invention. The boot shell 1 is formed conventionally by molding from a plastics material, and includes a main body of which the rearward or heel area 3 is shown.

The shell 1 further includes a bootleg portion consisting of a forward bootleg half 6 and a rearward bootleg half 7 which are conventionally attached to the main body 3 pivotally about respective pivots 4, 5. The bootleg halves 6, 7 qualify, on account of their mutual arrangement, the boot shell 1 for rear entrance, and can be clamped to each other around a padded inner shoe (not shown) using conventional fastening means (not shown).

Said bootleg halves encircle an entrance 8 of the boot which will receive in use a corresponding skier's leg. At the top end of the entrance 8, the forward bootleg half 6 is relieved as at 9.

A plate-like lug 10 is provided close against the wall of the forward bootleg half which confronts the entrance 8. This lug has, in plan view, a substantially square shape with rounded corners and respective opposite sides 11 and 12, and carries a pivot pin 13 having an enlarge head 13*a* and being adapted to engage pivotally in a corresponding hole 14 formed through the bootleg half 6. By virtue of this pivotal engagement and the limited elastic deformability of both the shell and the lug 10, the latter will be pivotable relative to the shell into the two stable positions shown in FIGS. 1 and 2. The pivot 13 is located at different distances from the sides 11, 12, whereby the lug 10 will extend to a greater (FIG. 1) or lesser (FIG. 2) extent beyond the relief 9 of the entrance 8 according to which position it has been moved into relative to the shell. The portion of the lug 10 which is to project beyond the entrance in the above two working positions is denoted by 10*a* and 10*b*, respectively. Notice that the configuration of the plate-like lug is such that its side facing toward the bootleg half 6 and the corresponding surface of the bootleg half will mate with each other in either of said positions.

Thus, the lug 10 will act through its projecting portions 10*a,b* as an adjustable forward rest for the skier's leg. In particular with the lug 10 set to the position of FIG. 1, under a condition of full projection beyond the relief 9, greater resistance is opposed to the boot forward flexing, as experienced skiers are bound to prefer. On the other hand, the lug 10 setting shown in FIG. 2 is better suited to less exacting skiing situations.

Figure 5:
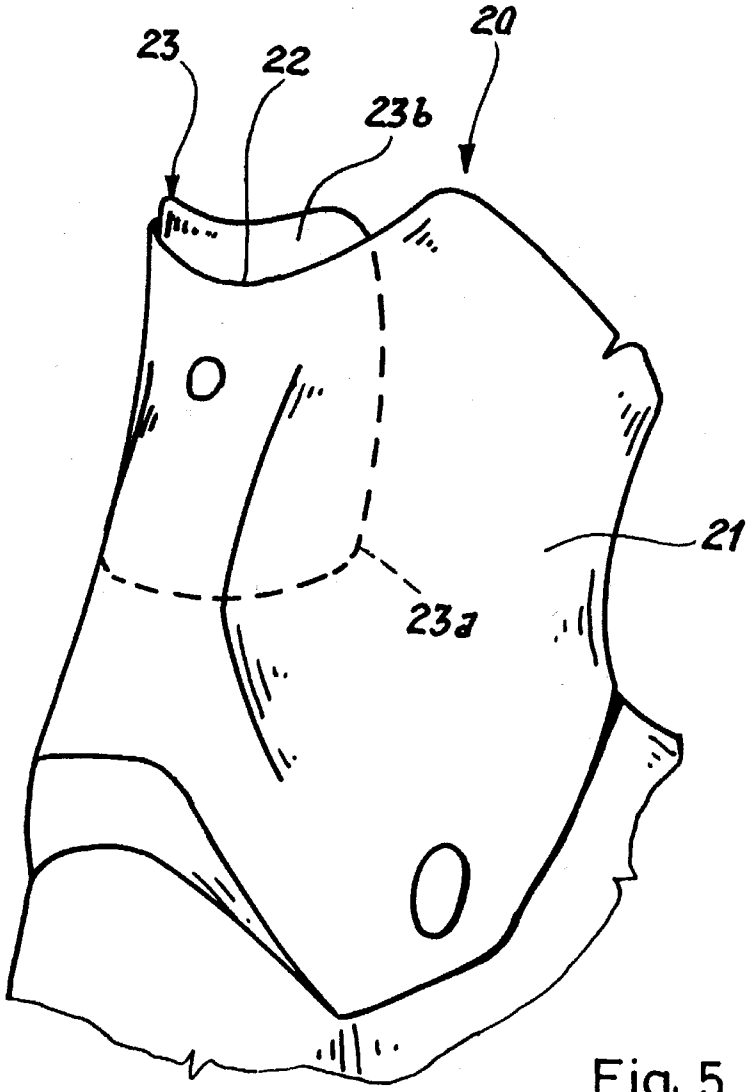
FIGS. 4 and 5 are fragmentary perspective views showing schematically a ski boot according to a second embodiment of the invention.
Figure 4:
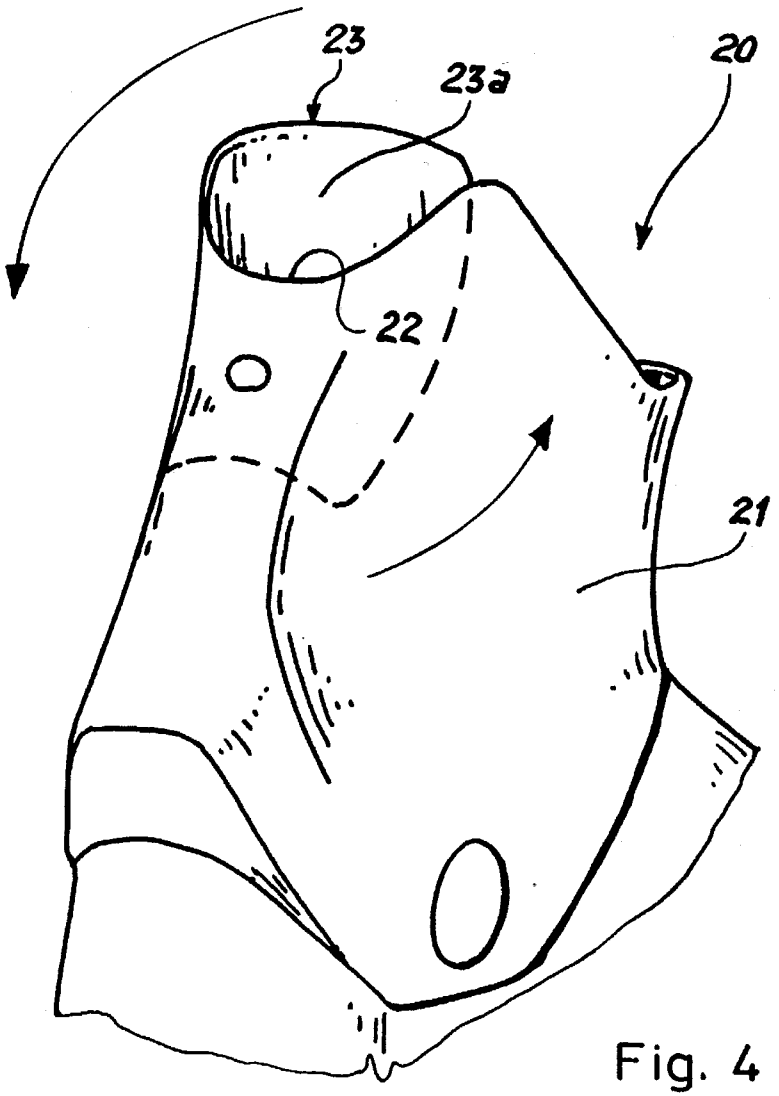

A second embodiment of a ski boot shell is shown generally at 20 in FIGS. 4 and 5. The shell 20 includes a bootleg portion 21 formed with the relief 22 in its rearward area. The plate-like lug 23 is again held pivotally on the shell by means of a pivot pin or stud with an enlarged head, similar to the lug 10. The lug 23 functions here as the boot rearward spoiler and can be moved between a position of full projection beyond the relief 22, specially adapted to facilitate the skiing trim of long-legged skiers with slim calves (FIG. 4) and the position shown in FIG. 5, better suiting skiers with fat calves and/or short legs. The lug 23 portions than will project beyond the entrance in the two working position settings shown are designate 23*a* and 23*b*, respectively.

Third and fourth embodiments of the invention are shown in FIGS. 6, 7 and 8, 9, respectively. These embodiments exhibit a bootleg portion 30 of a ski boot shell of the so-called front entrance type. That bootleg portion 30 is arranged for application to an otherwise conventional main body, e.g. of the type partly shown in FIGS. 4 and 5. In the bootleg portion 30, there are defined a rearward portion 31 which carries a spoiler 32, and a forward portion 33 which is divided into two normally overlapping flaps 33*a,b*. The flap 33*a* is conventionally formed of two bands 34, 35 on which respective fastening means (not shown) are secured for clamping the bootleg portion 30, and more generally the boot shell, around the skier's leg.

Figure 7:
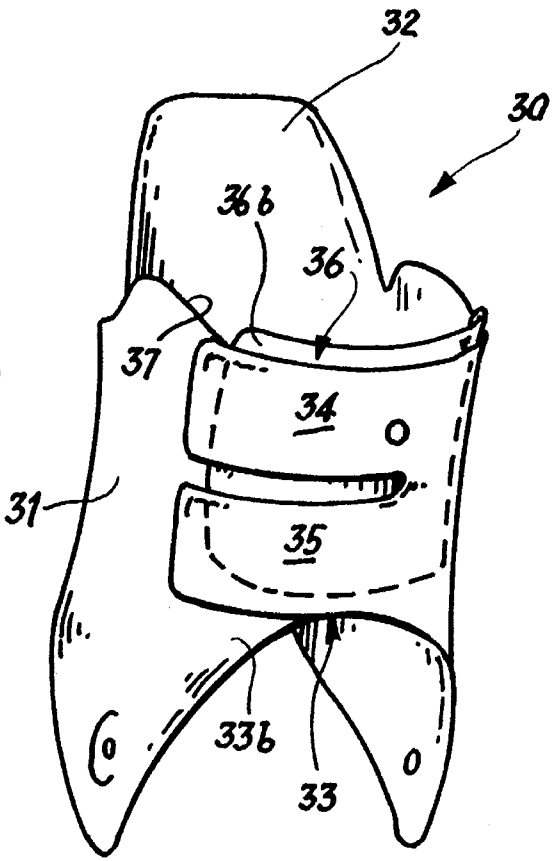
FIGS. 6 and 7 are fragmentary perspective views showing schematically a ski boot according to a third embodiment of the invention.
Figure 6:
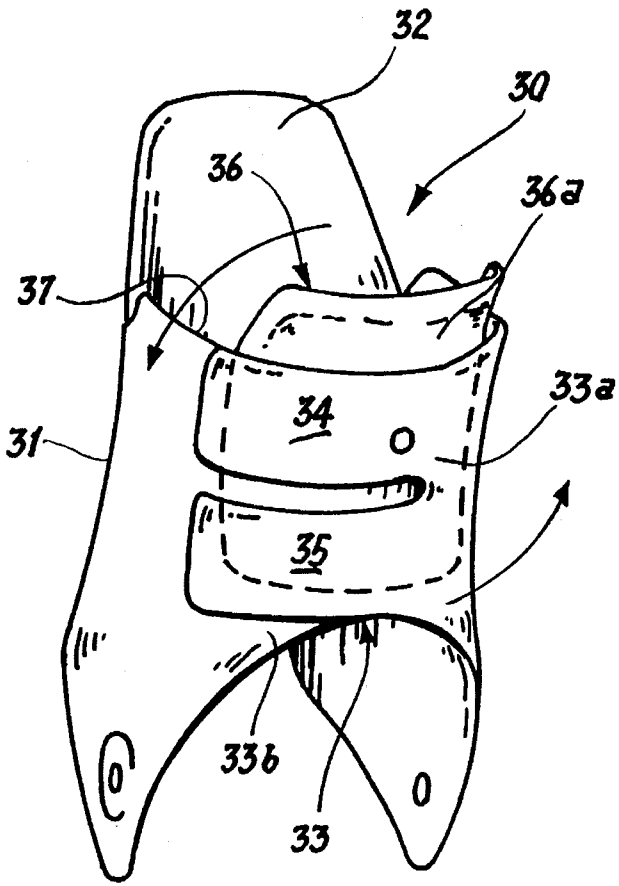

In the embodiment of FIGS. 6 and 7, the plate-like lug 36 is pivoted to the band 34 of the bootleg portion to support the front of the skier's leg in an equivalent manner of the embodiment in FIGS. 1–3. Notice that in either of the lug settings, the end of the lug 36 which does not project beyond the shell entrance 37 would in all events held by the second band against the flap 33*b* of the bootleg portion. The lug 36 portions which do project beyond the entrance 37, as respectively indicated at 36*a* (FIG. 6) and 36*b* (FIG. 7), again differ from each other by their spread.

Figure 9:
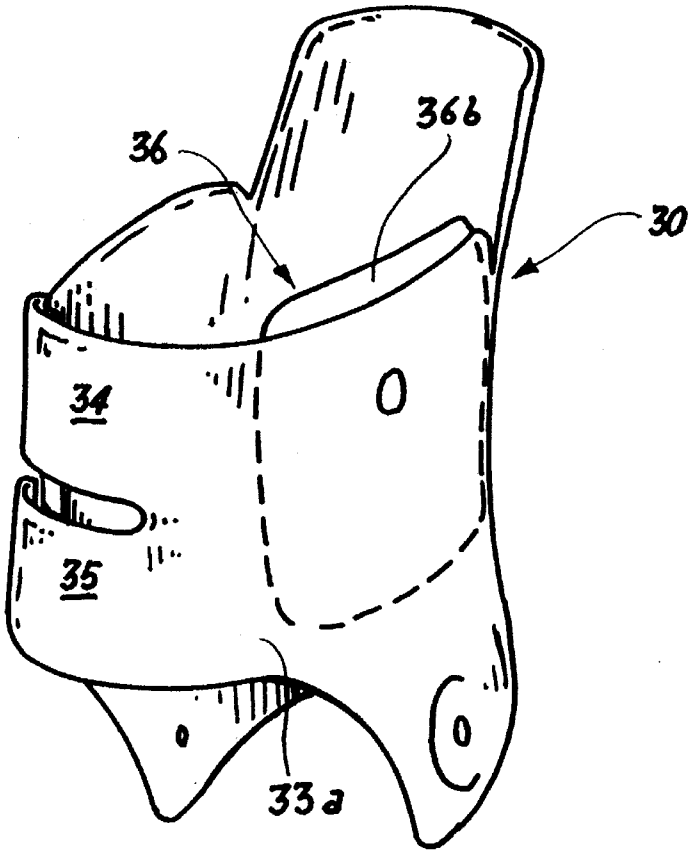
FIGS. 8 and 9 are fragmentary perspective views showing schematically a ski boot according to a fourth embodiment of the invention.
Figure 8:
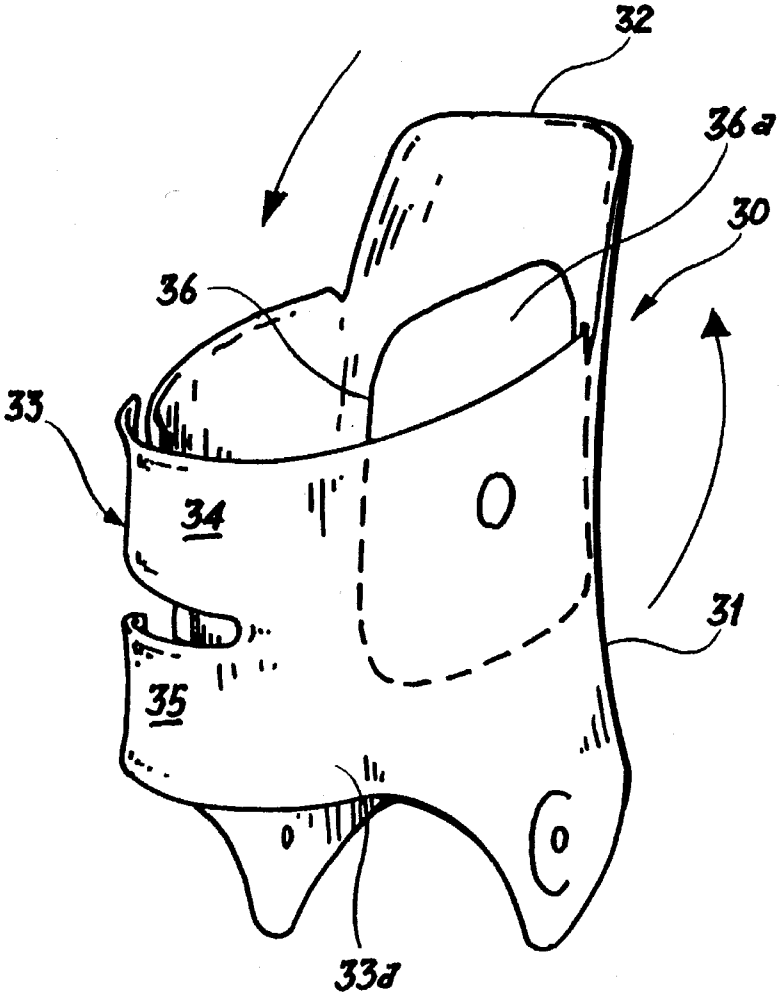
Figure 10:
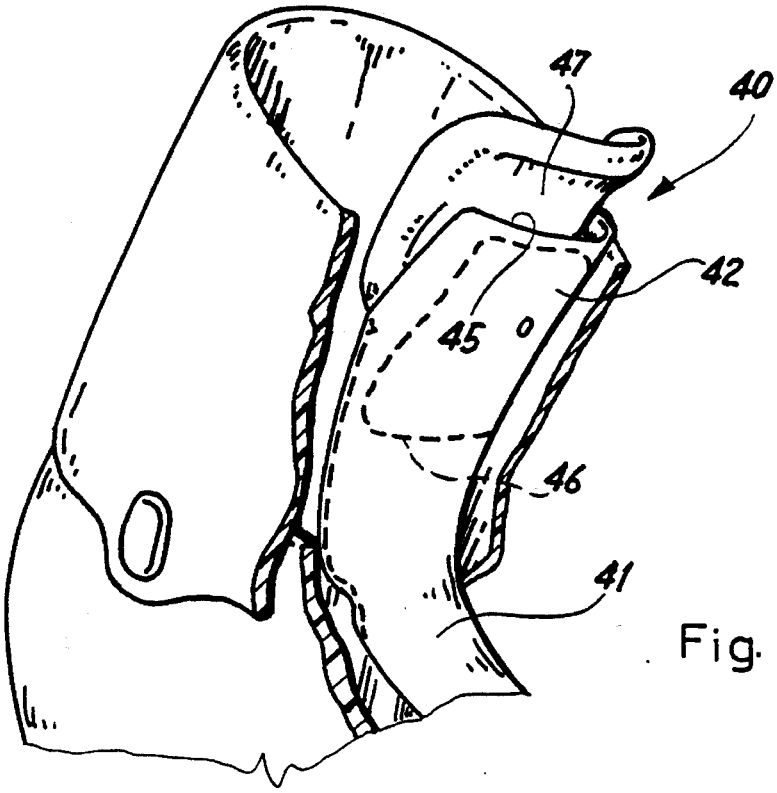
FIGS. 10 and 11 are fragmentary perspective views showing schematically a ski boot according to a fifth embodiment of the invention.

In the embodiment of FIGS. 8, 9, the plate-like lug 36 is pivoted to the bootleg portion 30 on one of its sides 38, preferably the inward side of the boot, i.e. the side facing toward the fastening means. Thus, the skier is afforded adjustable side support between a fully extended position (FIG. 8) where the projecting portion 36*a* of the lug 36 will impart enhanced features to the boot of responsiveness to the edge-on action of the ski, and a least extended position 36*b* (FIG. 9) of reduced responsiveness.

A fifth embodiment of the invention is shown in FIGS. 10 to 13, where generally shown at 40 is a forward entrance ski boot. This boot is provided with a forward tongue 41 which may be secured on the shell or be formed integrally with an inner shoe placed on the shell interior. The tongue 41 conventionally includes a comparatively stiff outer shield 42 and a soft pad 43 facing the boot interior.

The shield 42 of the tongue 41 is attached to the pad along most of the tongue spread by sewn seams 44. Said shield 42 is instead unattached to the pad 43 in the proximity of the shell entrance to define, in combination with the pad, a pouch 45. Notice that the pad extends beyond the free end of the shield 42 with a portion 47 which, by not being stiffened by the shield 42, would normally be quite flexible and deformable. Pivoted on the shield 42 at the location of the pouch 45 is a plate-like lug 46 which performs the same functions as the plate-like lug of the embodiments of FIGS. 1–3 and 6, 7.

Figure 11:
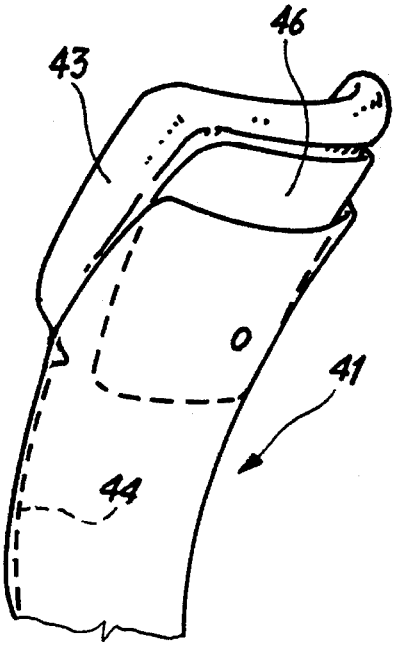
Figure 12:
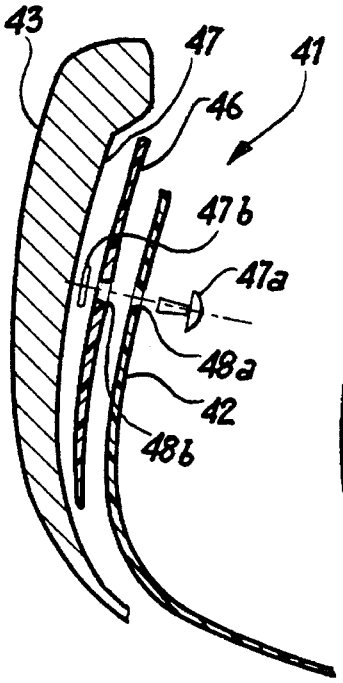
FIGS. 12 and 13 are longitudinal section views of two assembly variations of a detail of the embodiment in FIG. 10.
Figure 13:
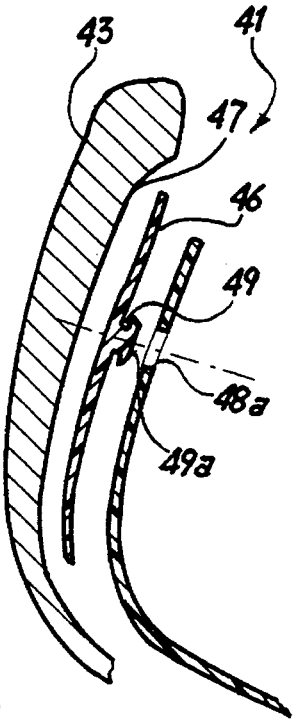

FIG. 12 shows in section an exploded view of the tongue in FIG. 11, wherein the lug 46 is pivoted to the shield 42 by means of a stud 47*a* and washer 47*b* engaged in respective holes 48*a,b* in the shield 42 and the lug 46. FIG. 13 shows a variation wherein the pivotal attachment is obtained by means of a pivot pin 49 having an enlarged head 49*a* and being engaged in the hole 48*a* in the shield 42.

In both instances, the lug 46 can be rotate to vary its spread beyond the shield 42 for the tongue 41 an alter the flexibility and deformability of the portion 47 of the pad 43.

It should be note that in all of the arrangements described above, the effect of the plate-like lug is one of providing a different counteraction of support for the skier's leg according to the setting of the lug relative to the shell into either working positions with portions of the lug opposite from the point of pivotal attachment projecting differentially at the location of the bootleg entrance.

Figure 14:
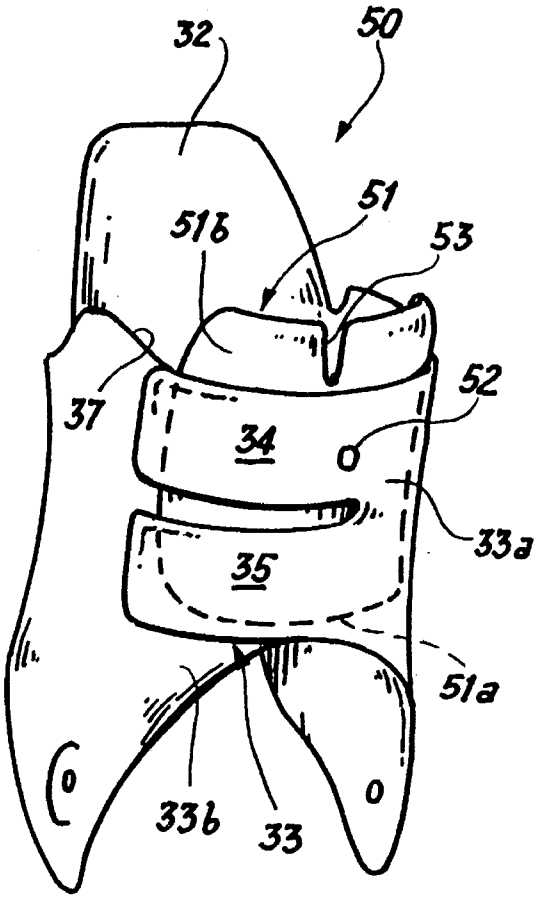
FIG. 14 is a fragmentary perspective view showing schematically a further embodiment of the invention.

This effect is obtained, according to a further embodiment of the invention shown generally at 50 in FIG. 14, by altering the elastic deformability of the opposed portions 51*a,b* of a plate-like lug generally shown at 51. This embodiment, while not specifically described herein, is substantially similar to that of FIGS. 6 and 7, and similar parts are denoted by the same reference numerals.

The lug 51 is pivoted, as mentioned in connection with the previous embodiments, to the bootleg 31 by means of a pivot pin or stud having an enlarged head 52 and being provided at a location not necessarily off-centered from the lug 51. Said lug 51 has two portions oppositely located from the pivot 52 and indicated at 51*a* and 51*b*, respectively. The portion 51*b* is formed with an indentation 53 or some other form of local weakening to enhance its elastic deformability when loaded, as against the portion 51*a* which is formed with no such weakening. This different elastic deformability may be combined, if desired, with a different spread of the portions 51*a,b* beyond the entrance 37 in accordance with the teachings of the previous embodiments.

Thus, the invention does solve the proposed problem using an advantageously simple, inexpensive and versatile construction. Furthermore, special demands can be advantageously filled by combining the various arrangements illustrated to provide a range of different support areas for the skier's leg.

I claim:

1. An article of sport footwear including a boot shell which incorporates a. bootleg portion encircling a boot entrance having a size sufficient to receive a leg therethrough, characterized in that said footwear includes a plate-like lug including first and second lug portions and a pivot pin, said lug located at the entrance of said boot shell and effective to provide predetermined support conditions for the leg, said lug being attached so as to be rotatably pivotable relative to the boot shell while the lug remains attached to the shell by the pivot pin and rotates into at least first and second working positions, so that when in said first working position, said lug presents said first lug position to said entrance and when pivoted into said second position, said lug presents said second lug portion to said entrance, such that the support conditions afforded for the leg can be changed by rotating said lug between said first and second positions.

2. An article of footwear according to claim 1, wherein said first and second lug portions presented to the entrance in said first and second working positions project beyond the entrance by different amounts.

3. An article of footwear according to claim 1, wherein said first lug portion has a different elastic resistance to deformation than said second lug portion, so that the first and second lug portions have a different stiffness from one another.

4. An article of footwear according to claim 3, wherein at least one of said first and second lug portions includes at least one area of localized weakening that provides decreased elastic resistance to deformation of the corresponding lug portion.

5. An article of footwear according to claim 1, wherein said lug is associated with the boot shell at the location of said bootleg portion.

6. An article of footwear according to claim 1, including a front tongue and wherein said lug is associated with the boot shell at the location of said front tongue.

7. An article of footwear according to claim 6, wherein said tongue comprises a shield and a pad, said lug being bonded to said shield and interposed between it and said pad.

8. An article of footwear according to claim 7, wherein a portion of said pad extends beyond the free end of said shield, and said lug, when in at least one of said first and second working positions, extends beyond the free end of said shield so as to act as a continuation of said shield against said pad portion.

9. An article of footwear according to claim 1, wherein said lug is pivoted to said boot shell.

10. An article of footwear according to claim 9, wherein two opposite sides are defined on said lug and said lug is pivoted to the boot shell at a location at unequal distances from said opposite sides.

11. An article of footwear according to claim 1, wherein said lug is associated with the boot shell at a forward portion of said bootleg portion.

12. An article of footwear according to claim 1, wherein said lug is associated with the boot shell at a rearward portion of said bootleg portion.

13. An article of footwear according to claim 1, wherein said lug is associated with the boot shell at a side portion of said bootleg portion.

14. An article of footwear according to claim 1, wherein said sports footwear is a ski boot.

* * * * *